United States Patent [19]

Lam et al.

[11] Patent Number: 4,839,990

[45] Date of Patent: Jun. 20, 1989

[54] APPARATUS AND METHOD OF A POWER SPRING COUNTERBALANCE FOR TAPE DRIVE WINDOW REGULATORS

[75] Inventors: Michael K. Lam, Southfield; Bohdan Kazewych, Union Lake; Edmond R. Gionet, Royal Oak, all of Mich.

[73] Assignee: General Motors Corporation, Detroit, Mich.

[21] Appl. No.: 933,202

[22] Filed: Nov. 21, 1986

[51] Int. Cl.[4] ..... E05F 11/48

[52] U.S. Cl. ..... 49/352; 49/360

[58] Field of Search ..... 49/352, 374, 375, 376, 49/360

[56] References Cited

U.S. PATENT DOCUMENTS

| | | | |
|---|---|---|---|
| 3,281,991 | 11/1966 | Colell | 49/352 |
| 3,681,874 | 8/1972 | Golde et al. | 49/352 |
| 3,890,743 | 6/1975 | Eckhardt et al. | 49/352 |
| 4,306,378 | 12/1981 | Fukura et al. | 49/352 |
| 4,330,960 | 5/1982 | Hasemann et al. | 49/360 X |
| 4,364,202 | 12/1982 | Zavatkay | 49/352 |
| 4,400,913 | 8/1983 | Krantz et al. | 49/352 |
| 4,433,509 | 2/1984 | Seppala | 49/352 |

FOREIGN PATENT DOCUMENTS

| | | | |
|---|---|---|---|
| 1929763 | 12/1970 | Fed. Rep. of Germany | 49/352 |

*Primary Examiner*—Philip C. Kannan

*Attorney, Agent, or Firm*—Ernest E. Helms

[57] ABSTRACT

The present invention provides an apparatus and a method of the utilization of the same of a tape drive window regulator with a counterbalance. The counterbalance decreases the amount of torque required for the winder to raise the window glass. An embodiment of the present invention provides a window regulator wherein the drive tape is always in a tension mode.

9 Claims, 3 Drawing Sheets

APPARATUS AND METHOD OF A POWER SPRING COUNTERBALANCE FOR TAPE DRIVE WINDOW REGULATORS

FIELD OF THE INVENTION

The present invention relates to tape drive vehicle window regulators.

DISCLOSURE STATEMENT

It is well known in the art to provide a vehicle window regulator utilizing a flexible polymeric tape as the drive member. Most tape drive window regulators are installed in such a manner that one end of the tape is attached to the window adjacent the bottom edge of the window. The tape is then routed through a generally vertically oriented rail guide structure. Typically towards its upper end, the rail will curve laterally or laterally downward to a winder mechanism. The manually or artificially powered winder mechanism typically will be a sprocket wheel which is drivably engaged with a series of slots provided in the drive tape.

When raising the window, the winder pulls on the drive tape placing the drive tape in tension. The pulling force exerted by the winder overcomes the weight of the window glass and pulls the window glass in an upward direction. To lower the window the winder places the tape in compression, pushing the drive tape and the attached window in a downward direction. It is apparent to those skilled in the art that a greater amount of torque is required in raising the window because the weight of the window acts in a direction counter to the direction of motion of the drive tape. It is desirable that the torque required for raising the window be lowered to be more uniform with respect to the torque required by the winder when lowering the window.

When the drive tape is placed in compression during the lowering of the window, the tape has a tendency to snake or bend within the rail. The snake effect increases the friction of the tape with the rail member, causing an increase in the torque required for lowering the window. Also compression loading of the tape diminishes the life of the drive tape. Therefore, it is desirable to provide a tape drive window regulator wherein the tape is always utilized in a tension mode.

A more detailed understanding of the working of tape drive window regulators may be gained by a review of commonly assigned U.S. patent application "Tape Drive Window Regulator Apparatus and Method", Ser. No. 864,510, filed May 19, 1986, commonly assigned.

SUMMARY OF INVENTION

To meet the above noted and other desires the present invention is brought forth. The present invention provides a tape drive window regulator wherein the drive tape is counterbalanced. Energy is stored from the tape as the tape lowers the window glass. The stored energy is released to the tape as the tape raises the window glass thereby decreasing the amount of torque required when raising the window. An alternative embodiment of the present invention provides a tape drive window regulator with a closed loop tape. Therefore the tape is in tension when the window is being raised or lowered. Compression loading of the tape and the problems associated with compression loading may be avoided.

It is an object of the present invention to provide an apparatus and a method of utilization of the same of a vehicle tape drive window regulator having a counterbalance means. It is another object of the present invention to provide a vehicle tape drive window regulator having a closed loop tape drive member.

It is yet another object of the present invention to provide a tape drive window regulator including a slotted closed loop drive tape connected with the window, guide means providing a fixed path for the tape, a housing with a mounted sprocket winder gear drivably engaged with the tape for moving the tape in first and second directions, and a sprocket counterbalance gear mounted to the housing drivably engaged with the tape and in mesh with the winder gear whereby energy is stored from the tape when the tape is moving in the first direction and energy is released to the tape when the tape is moving in the second direction.

It is still yet another object of the present invention to provide a method of regulating a vehicle window utilizing a tape drive vehicle window regulator, the method including connecting the window with a drive tape, guiding the tape in a fixed path, drivably engaging the tape to move the tape in first and second directions with a winder gear, and meshing with the winder gear a counterbalance gear whereby energy is stored from the tape when the tape is moving in the first direction and energy is released to the tape when the tape is moving in the second direction.

Other objects, desires, and advantages of the present invention will become more apparent to those skilled in the art as a nature of the invention is better understood from the accompanying drawings and a detailed description.

DETAILED DESCRIPTION OF THE DRAWINGS

Figure 1:
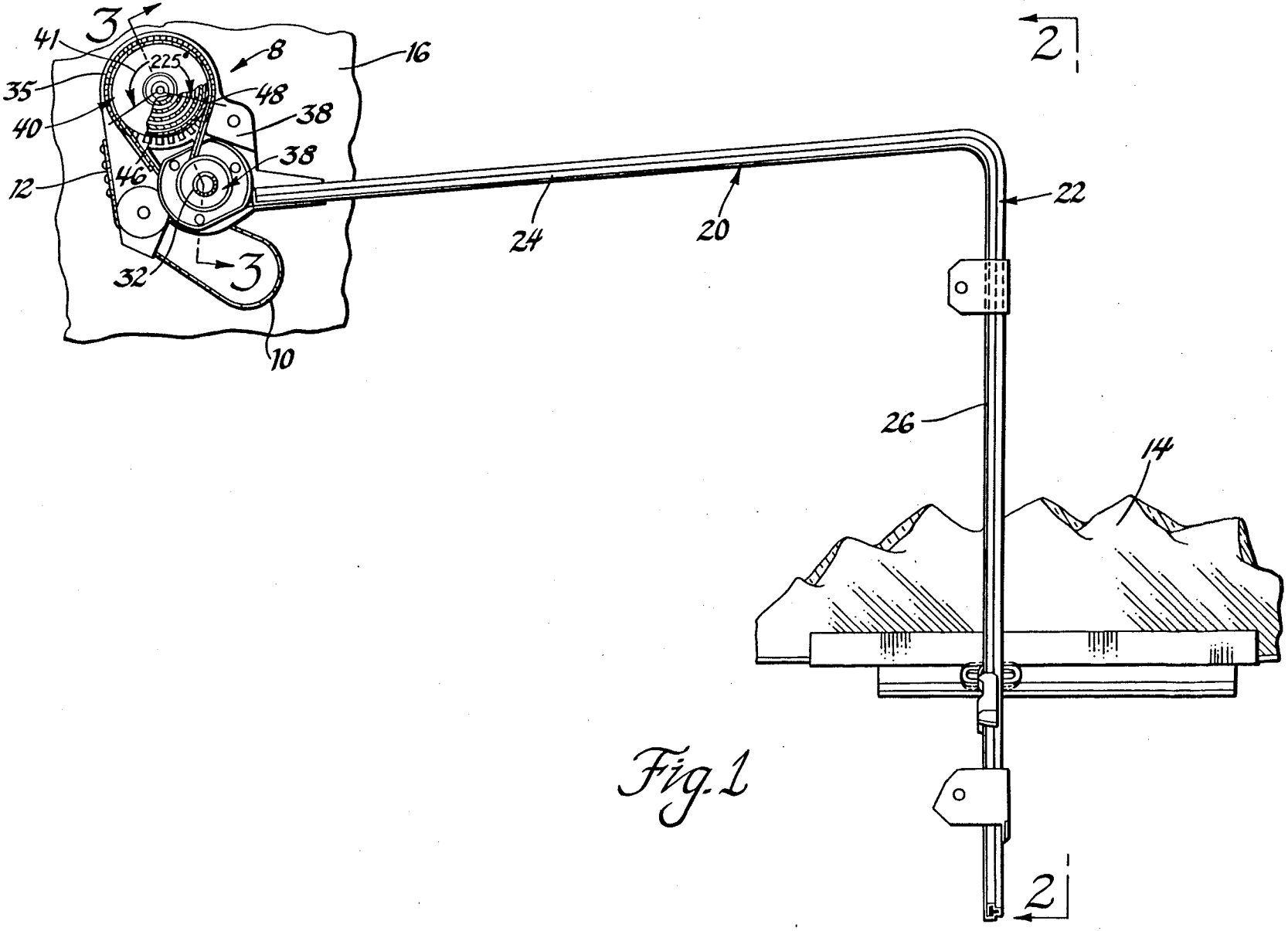
FIG. 1 is a front elevational view with portions cut away of a preferred embodiment window regulator of the present invention installed in an automotive vehicle environment.
Figure 2:
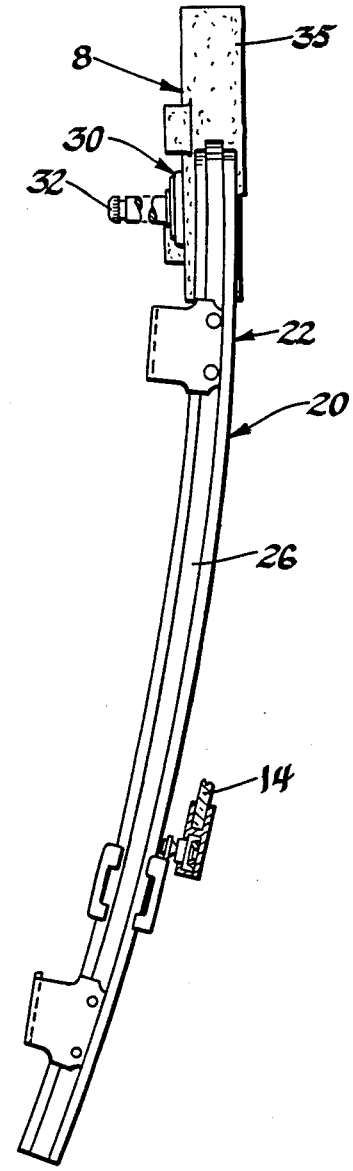
FIG. 2 view taken along line 2—2 of FIG. 1.
Figure 3:
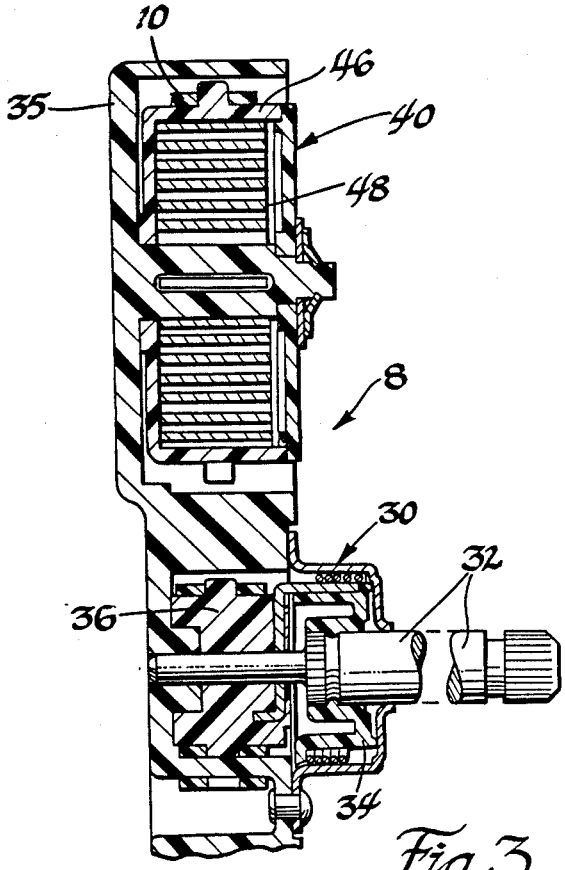
FIG. 3 a view taken along line 3—3 of FIG. 1.
Figure 4:
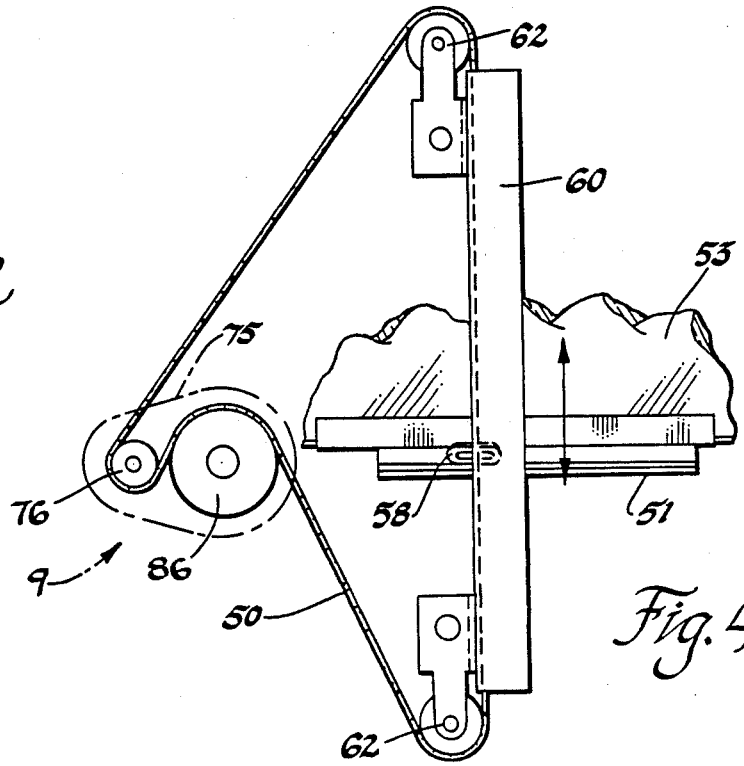
FIG. 4 is a front elevational view with portions removed for clarity of illustration of an alternative embodiment of the present invention.
Figure 5:
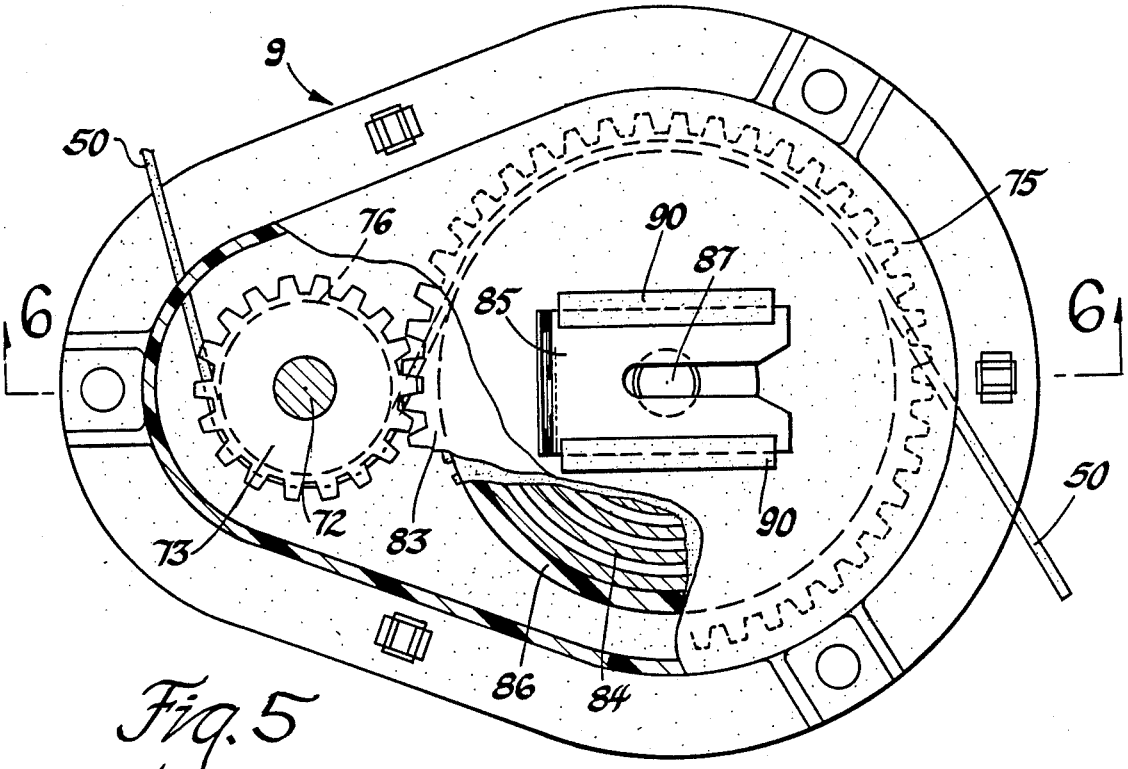
FIG. 5 is an enlarged sectional view mainly in front elevation w portions cut away of a portion of the window illustrated in FIG. 4.
Figure 6:
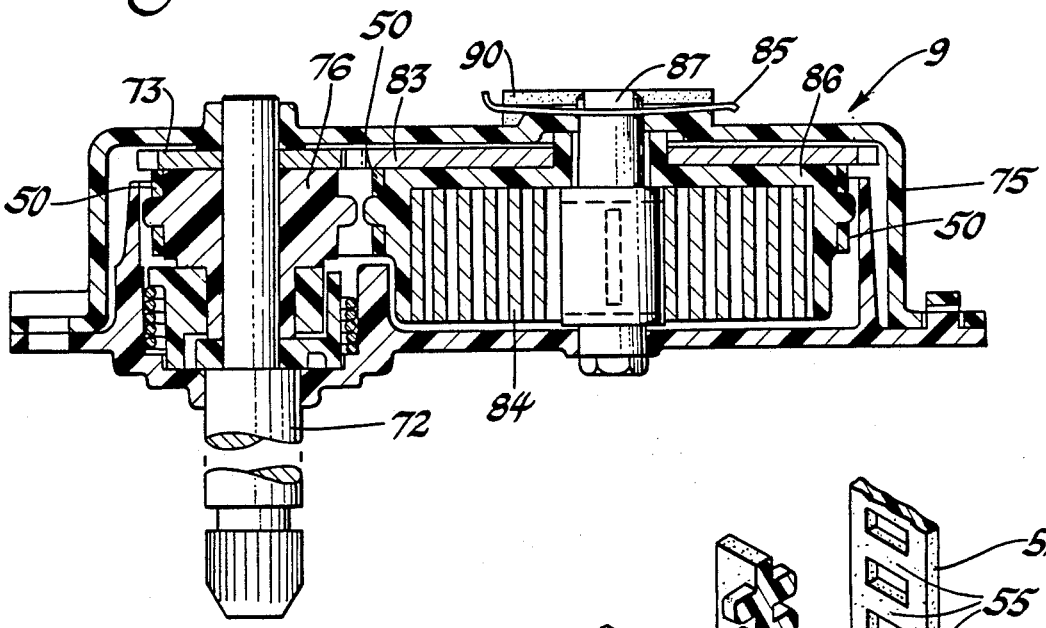
FIG. 6 is a view taken along line 6—6 of FIG. 5.
Figure 7:
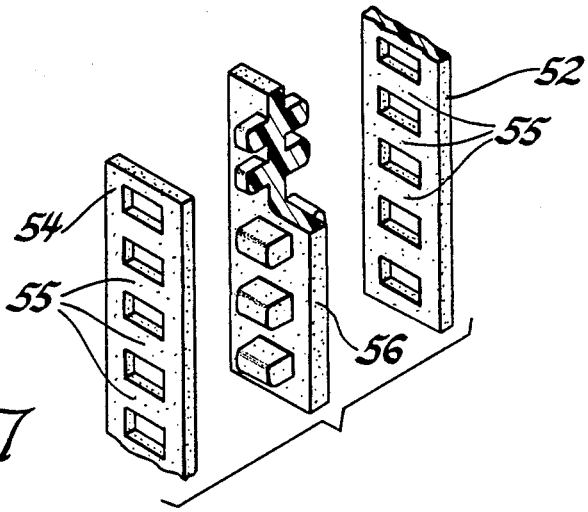
FIG. 7 is an exploded sectional view mainly in perspective with portions cut away of the tape connector with both ends of the drive tape.

Referring to FIGS. 1, 2, and 3, the vehicle window regulator 8 of the present invention has four major elements. The first major element is the drive tape 10 which is typically manufactured from extruded polymeric material having a series of longitudinally equally spaced transverse slots. One end of the tape 10 will be connected to the window 14 and the other end 12 of the tape 10 is typically fixed with respect to the vehicle body 16. Providing a fixed path for the tape 10, is the second major element, the guide means 20. As illustrated in FIGS. 1 and 2, the guide means 20 includes a rail member 22 having a horizontal portion 24 and a descending leg 26.

The third major element of the vehicle window regulator 8 is the winder 30. The winder 30 may be powered artificially or manually, and is provided for engaging and moving the tape 10 along the guide means 20 in a first direction and a second opposite direction. The last major element of the vehicle window regulator 8 is the counterbalance means 40. The counterbalance means 40 engages the tape 10 along an arc 41 exceeding 90°, and as shown in FIG. 1 exceeding 180°. The counterbalance means 40 also stores energy from the tape 10 when the tape 10 moves in the first direction. The counterbalance means 40 releases energy to the tape 10 when the tape 10 is moving in the second direction.

The winder 30 and counterbalance means 40 are rotatably mounted to a common housing 35. The winder 30 has a shaft 32 which is fixably connected with a winder clutch mechanism 34. A more detailed explanation of winder clutch mechanisms may be gained by a review of Roethel U.S. Pat. No. 2,145,666. The winder 30 and counterbalance means 40 have sprocketed drums 36 and 46 respectively to drivably engage with the slots of tape 10.

The counterbalance drum 46 is rotatably mounted to the housing 35. Counterbalance drum 46 encircles and is connected with a coil torsional spring 48 (FIG. 1). When the tape 10 is being translated away from the housing 35 through the guide rail 22 to lower the window 14, the tape 10 winds up the spring 48. When the tape 10 is being retracted to raise window 14, the spring 48 releases energy to the tape 10 and thereby lessens the torsional load required by the winder 30 to translate the window 14 in an upward direction.

Referring to FIGS. 4, 5, 6, and 7, an alternative preferred embodiment of the present invention provides a window regulator 9 having a closed loop drive tape 50. The tape ends 52 and 54 are connected together by a connector plate 56. A slider 58 is fixably attached to the tape 50 and is in turn mounted to the sash 51 of the window 53. The tape is directed through a fixed path provided by a guide means including a channel 60 with rollers 62 mounted at opposite ends. The tape 50 is then looped through the housing 75. The housing 75 has a rotatively mounted sprocket winder gear drum 76 which operates essentially as the winder drum 36 previously described. Also rotatively mounted to housing 75 is a sprocket counterbalance gear drum 86, which also functions in a manner similar as the counterbalance drum 46 previously described. The winder gear drum 76 and the counterbalance gear drum 86 are integral or fixably attached with winder gear 73 and counterbalance gear 83 respectively. Winder gear 73 and counterbalance gear 83 are meshed with one another. The counterbalancing force is directly transmitted to the winder handle 72 via the winder gear 73 and counterbalance gear 83. The S-type engagement of the tape 50 with winder gear drum 76 and counterbalance gear drum 86 allows a greater number of sprocket teeth to be engaged with the tape 50, thereby decreasing the load experienced by any one of the transverse members 55 of the tape.

The preset spring rate of torsion spring 84 is adjustable by rotation of torsion shaft 87. Torsion shaft 87 is restrained by spring 85 which fits into flanges 90 of housing 75. Therefore the spring rate of torsion spring 84 can be adjusted for the use of window regulator 9 in different vehicle applications.

In operation, the tape 50 is constantly in the tension mode. When the window 53 is lowered the torsion spring 84 is wound up, when the window 53 is raised the torsion spring 84 releases energy to the tape 50.

The present invention provides a method of regulating a vehicle window 53, including the following steps:

1. Connecting a window 53 with a tape 50;
2. Guiding the tape 50 in a fixed path 60;
3. Drivably engaging the tape 50 to move the tape 50 in the first and second directions with a winder gear 73;
4. Meshing with the winder gear 73 a counterbalance gear 83 whereby energy is stored from the tape 50 when the tape is moving in the first direction and energy is released to the tape when the tape is moving in the second direction.

While a few of the embodiments of the present invention have been explained, it will be readily apparent to those skilled in the art of the various modifications which can be made to the present invention without departing from the spirit and scope of this application as it is encompassed by the following claims.

The embodiments of the invention in which an exclusive property or privilege is claimed are defined as follows:

1. A vehicle tape drive window regulator, said regulator comprising in combination:

a drive tape connected with said window;

guide means providing a fixed path for said tape;

a winder gear drivably engaged with said tape for moving said tape in first and second directions; and a counterbalance gear drivably engaged with said tape, and said counterbalance gear being in mesh with said winder gear whereby energy is stored from said tape when said tape is moving in said first direction and energy is released to said tape when said tape is moving in said second direction.

2. A window regulator as described in claim 1 wherein said winder gear and said counterbalance gear are mounted to a common housing.

3. A window regulator as described in claim 1 wherein said tape is slotted and said winder gear and said counterbalance gear have respective sprocket drums.

4. A window regulator as described in claim 1 wherein said drive tape is a closed loop.

5. A window regulator as described in claim 1 wherein said counterbalance gear is connected with a torsion spring.

6. A window regulator as described in claim 5 wherein said counterbalance spring has an adjustable spring constant.

7. A tape drive window regulator, said regulator comprising in combination;

a slotted drive tape connected with said window;

guide means providing a fixed path for said tape;

a housing with a rotatably mounted sprocket winder gear drivably engaged with said tape for moving said tape in first and second directions; and a sprocket counterbalance gear rotatably mounted to said housing drivably engaged with said tape and in mesh with said winder gear whereby energy is stored from said tape when said tape is moving in said first direction and energy is released to said tape when said tape is moving in said second direction.

8. A tape drive window regulator, said regulator comprising in combination;

a slotted closed loop drive tape connected with said window;

guide means providing a fixed path for said tape;

a housing with a mounted sprocket winder gear drivably engaged with said tape for moving said tape in first and second directions; and a sprocket counterbalance gear mounted to said housing drivably engaged with said tape and in mesh with said winder gear whereby energy is stored from said tape when said tape is moving in said first direction and energy is released to said tape when said tape is moving in said second direction.

9. A method of regulating a vehicle window, said method in combination comprising:

connecting a drive tape with said window;

guiding said tape in a fixed path;

drivably engaging said tape to move said tape in said first and second directions with a winder gear; and meshing with said winder gear and drivably engaging with said tape a counterbalance gear whereby energy is stored from said tape when said tape is moving in said first direction and energy is released to said tape when said tape is moving in said second direction.

* * * * *

UNITED STATES PATENT AND TRADEMARK OFFICE

CERTIFICATE OF CORRECTION

PATENT NO. : 4,839,990

DATED : June 20, 1989

INVENTOR(S) : Michael K. Lam; Bohdan Kazewych; and Edmond R. Gionet

It is certified that error appears in the above-identified patent and that said Letters Patent is hereby corrected as shown below:

Title Page [75] Inventors "Michael K. Lam, Southfield; Bohdan Kazewych, Union Lake; Edmond R. Gionet, Royal Oak, all of Mich." should read -- Edmond R. Gionet, Royal Oak, Michigan --.

Signed and Sealed this

Fifteenth Day of May, 1990

*Attest:*

HARRY F. MANBECK, JR.

*Attesting Officer*

*Commissioner of Patents and Trademarks*